US005711441A

United States Patent [19]

Adams et al.

[11] Patent Number: 5,711,441

[45] Date of Patent: Jan. 27, 1998

[54] ONE-PIECE FITMENT HAVING RECLOSURE CAP

[75] Inventors: Brian M. Adams, Newark; Adam Green, San Mateo; Jack L. Watts, Atherton, all of Calif.

[73] Assignee: Portola Packaging, Inc., San Jose, Calif.

[21] Appl. No.: 697,953

[22] Filed: Sep. 4, 1996

[51] Int. Cl.[6] ..... B65D 17/40; B65D 1/02

[52] U.S. Cl. ..... 215/48; 215/256; 215/47; 222/541.5; 222/541.9

[58] Field of Search ..... 220/265, 266, 220/270, 276; 215/46, 47, 48, 50, 54, 250, 252, 254, 256; 222/541.5, 541.6, 541.9

[56] References Cited

U.S. PATENT DOCUMENTS

| | | | |
|---|---|---|---|
| 3,135,441 | 6/1964 | Wise et al. . | |
| 3,998,354 | 12/1976 | Song . | |
| 4,019,663 | 4/1977 | Gunter . | |
| 4,463,867 | 8/1984 | Magel | 215/47 X |
| 4,669,640 | 6/1987 | Ando et al. . | |
| 4,671,420 | 6/1987 | Marcus | 215/50 X |
| 4,703,610 | 11/1987 | Bach | 215/48 X |
| 5,108,029 | 4/1992 | Abrams et al. . | |
| 5,174,465 | 12/1992 | Luch et al. . | |
| 5,249,695 | 10/1993 | Luch et al. . | |
| 5,271,519 | 12/1993 | Adams et al. . | |
| 5,301,849 | 4/1994 | Guglielmini et al. . | |
| 5,303,837 | 4/1994 | Adams et al. . | |
| 5,348,184 | 9/1994 | Adams et al. . | |
| 5,512,228 | 4/1996 | Adams et al. . | |

FOREIGN PATENT DOCUMENTS

| | | | |
|---|---|---|---|
| 744825 | 4/1933 | France | 215/256 |
| 1435985 | 3/1966 | France | 215/47 |
| 1517037 | 2/1968 | France | 215/252 |
| 2042538 | 2/1971 | France | 215/48 |
| 935117 | 8/1963 | United Kingdom | 215/48 |

*Primary Examiner*—Allan N. Shoap
*Assistant Examiner*—Nathan Newhouse
*Attorney, Agent, or Firm*—Julian Caplan; Flehr Hohbach Test Albritton & Herbert LLP

[57] ABSTRACT

An internal fitment has a bottom peripheral flange adapted to be ultrasonically welded or otherwise attached to a panel of a paperboard carton surrounding a hold in such panel. Above the flange is a spout which converges upwardly and has a cylindrical external locking bead. Above the spout is an outward slanted tear band and above the tear band is a reclosure cap having a top, a depending skirt formed with internal interrupted beads and a plug. The tear band is connected to the spout and cap by thin horizontal tear lines. A finger grip tab extends outwardly of downward with respect to the tear band so that the consumer may conveniently grip the tab, pulling it circumferentially around the spout to separate the tab from both spout and cap. The cap is dimensioned so that the skirt fits over the outside of the spout, the beads detachably locking under the locking bead. The plug seals against the inside of the spout to prevent spillage.

19 Claims, 3 Drawing Sheets

ONE-PIECE FITMENT HAVING RECLOSURE CAP

BACKGROUND OF THE INVENTION

1. Field of the Invention

This invention relates to a new and improved one-piece fitment having a reclosure cap. The fitment may be attached to a container surrounding a hole therein and is characterized in that it has an outward-slanted tear band positioned above the fitment spout and beneath a reclosure cap. Before its removal, the reclosure cap functions as a tamper-evident closure for the spout. When the tear band is pulled off, the fitment may be opened and the upper portion thereof used as a reclosure cap.

2. Related Art

Fitments attached to the paperboard panels of cartons for juice and milk are becoming increasingly important. Such fitments conventionally have a spout attached to the paperboard carton by a peripheral flange and further have a cap which is attached to the spout and further have tamper-evidencing means. A one-piece intermediate product cap of this type is shown in U.S. Pat. Nos. 5,249,695 (FIGS. 10–20), 5,348,183, 5,174,465 and 5,271,519.

In one modification of the present invention, the cap is snapped onto the spout for reclosure purposes after the tear band has been removed. In another modification of the invention, the cap is screwed onto the spout. Snap-on and screw-on caps have been used in the container art for many years but never as parts of one-piece fitments wherein there is a removable interconnecting tear band.

U.S. Pat. No. 5,249,695 shows as an intermediate product or a consumer product comprising a spout having internal threads joined at its upper edge to the lower edge of a cap having external threads. The cap may be disconnected from the spout and used as a reclosure cap. However it will be noted that the external threads of the cap are exposed to dirt and other contaminants when the fitment is in its initial condition and thus may later contaminate the contents of the container.

SUMMARY OF THE INVENTION

The present invention comprises a one-piece fitment which is inexpensive to manufacture in that it is unnecessary for the cap to be assembled on the spout prior to attachment of the fitment to a container.

Another feature of the invention is the fact that the fitment is tamper-evidencing in that it has a tear band which, when torn off, provides a separate spout and a separate cap. When used as a reclosure cap, the cap skirt is applied over the outside of the spout and an internal hollow plug or depression depending from the cap top engages the inside of the upper edge of the spout to seal the spout closed. In initial condition both these surfaces are enclosed. Hence contamination of the primary seal surfaces is prevented. The reclosure cap may be used repeatedly.

Another feature of the invention is the "hour glass" shape of the interior of the fitment. This shape facilitates stripping the fitment out of the mold in which it is formed.

Although the invention is illustrated and described herein for use with a paperboard container such as a juice or milk carton, nevertheless it will be understood that the fitment may be applied to dispense from a wide variety of containers.

BRIEF DESCRIPTION OF THE DRAWINGS

The accompanying drawings, which are incorporated in and form a part of this specification, illustrate embodiments of the invention and, together with the description serve to explain the principles of the invention.

DETAILED DESCRIPTION OF THE PREFERRED EMBODIMENT

Figure 2:
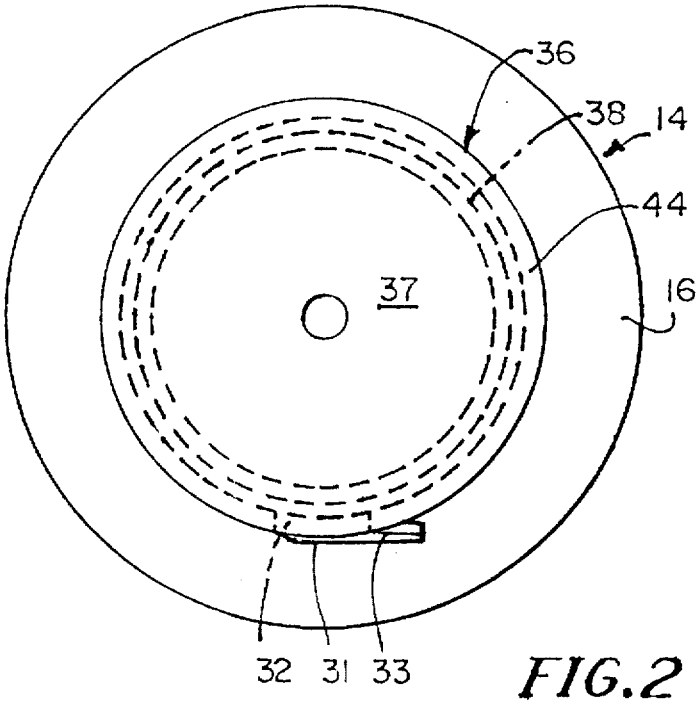
FIG. 2 is a top plan view of the fitment of FIG. 1.
Figure 1:
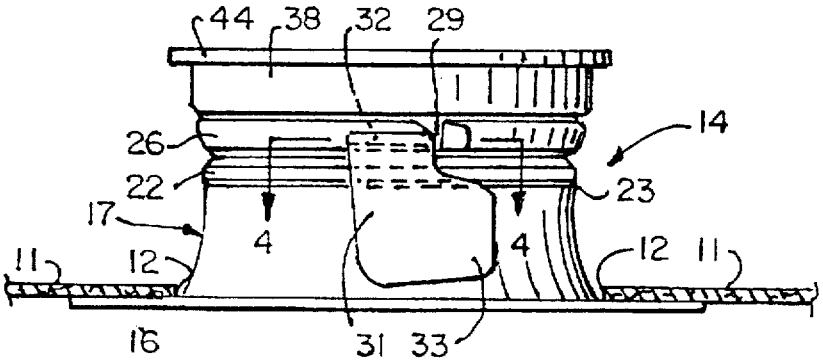
FIG. 1 is a side elevational view of one modification of a fitment in accordance with the present invention shown installed on a panel of a paperboard container.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

More particularly, the fitment 14 of the present invention is usable with containers of many different kinds. In the accompanying drawings the fitment is shown used with a paperboard carton for juices, milk and the like, conventionally being attached to one of the panels of a tent-type top container widely used in such cartons. It will be understood that the invention may be used with many other containers.

In the form of container illustrated, carton panel 11 is formed with a circular hole 12. Fitment 14 is inserted in the interior of the carton and projects outward through the hole 12. It will be understood that it could also be applied to the exterior. Peripheral flange 16 of the fitment fits against the underside of panel 11 surrounding the hole 12 and may be attached thereto by ultrasonic welding, adhesives or other convenient means. Spout 17 extends upward relative to flange 16 and has a substantially cylindrical lower portion 18, an inwardly upwardly conical intermediate portion 19 and a cylindrical upper portion 21. On the exterior of cylindrical portion 21 is an external bead 22 having a shoulder 23 at its lower edge.

Figure 4:
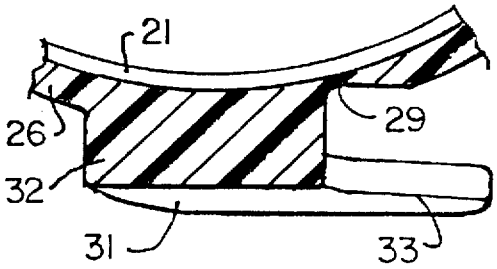
FIG. 4 is an enlarged fragmentary sectional view taken substantially along the line 4—4 of FIG. 1.

Above spout 17 is tear band 26 which slants upwardly outwardly relative to cylindrical portion 21 and is defined by horizontal lower tear line 27 and upper tear line 28. As best shown in FIG. 4, a vertical thin portion 29 is located at one position of band 26. Spaced outwardly of spout 17 is substantially vertical tear tab 31 connected to band 26 by a horizontal connector 32 of limited arcuate width. A lateral extension 33 of tab 31 may conveniently be gripped by the consumer in order initially to open the fitment, as hereinafter explained.

Above tear band 26 and separated therefrom by tear line 28 is cap 36 which has a top 37 closing off the upper end of the fitment. Depending from top 37 is a circumferential skirt 38 formed spaced upward from its lower edge with internal interrupted bead segments 39. Also depending from top 37 is a hollow plug 41 having a curved lower outer edge 42. It will be noted that the dimensions of top 37 are greater than the circumference of skirt 38 so that there is a peripheral flange 44 projecting outwardly.

In the particular embodiment illustrated, before filling the carton, fitment 14 is deposited inside panel 11 and then moved outwardly through hole 12 which is of a diameter such that the flange 44 maybe projected outwardly therethrough. Flange 16 contacts the inside of the panel 11 and is secured thereto by ultrasonic welding, by adhesives or other means as well understood in the fitment equipment art. So long as the fitment 14 is intact, it is tamper-evidencing and all internal surfaces are sealed from contamination.

In order to open the carton, the consumer grips the tab 31 and pulls circumferentially around the fitment. The vertical thin portion 29 fractures as do the tear lines 27 and 28 so that the tear band 26 may be completely removed from spout 14 and also completely removed from cap 36. The extension 33 may be gripped conveniently at any position of fitment 14 relative to the carton on which it is mounted, even when in close proximity to the crimped ridge of a tent-top container. Hence it is not necessary to orient the fitment when applying it to a container.

If the contents of the container are not completely dispensed, cap 36 may be used for reclosure purposes. The diameter of the interior of skirt 38 is approximately equal to the exterior diameter of cylindrical portion 21. Hence when the cap is pushed downward, the interrupted internal beads 39 of the cap skirt 38 snapping under the shoulder 23 of the external bead 22 of spout 17. At the same time, the hollow plug 41 enters the upper end of spout 17 and seals thereagainst. Curved edge 42 facilitates this operation.

Figure 3:
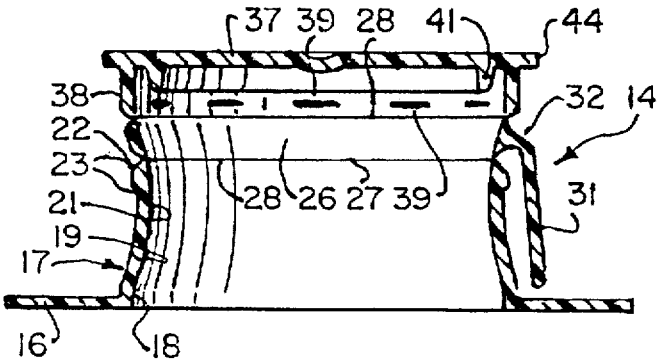
FIG. 3 is a vertical sectional view through the structure of FIG. 1.
Figure 5:
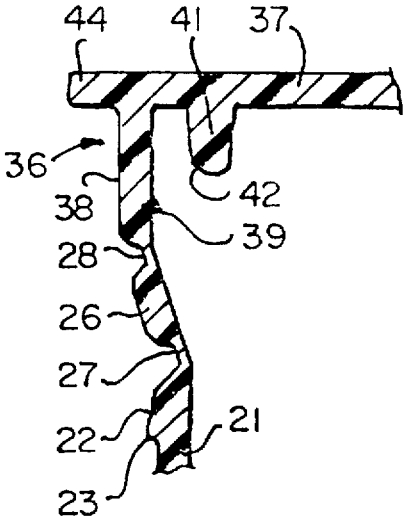
FIG. 5 is an enlarged sectional view of a portion of the structure of FIG. 3.
Figure 6:
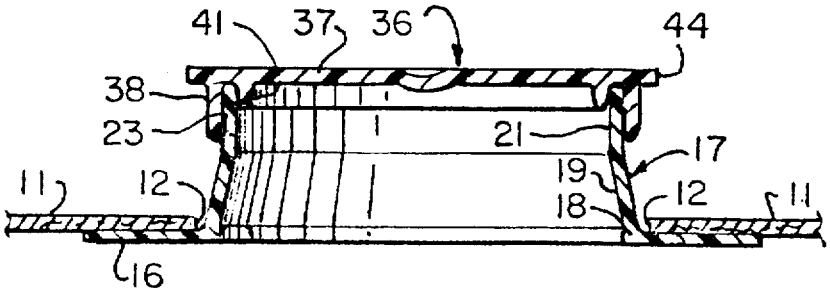
FIG. 6 is a vertical sectional view showing the fitment with the tear band removed and the reclosure cap applied onto the spout.

A feature of the invention is shown in FIG. 6 where it is shown that the contents of the container are sealed by plug 41 sealing against the inside of cylindrical portion 21. Both the seal surfaces are on the inside of the structure of FIG. 3 and hence are not exposed to dirt or other contaminates prior to initial opening.

If the consumer wishes to dispense more of the contents of the container, the user's fingers pry the peripheral flange 44 upward, causing the beads 39 to snap out from under the shoulder 23. The cap 36 may be used for reclosure purposes as often as required.

Figure 7:
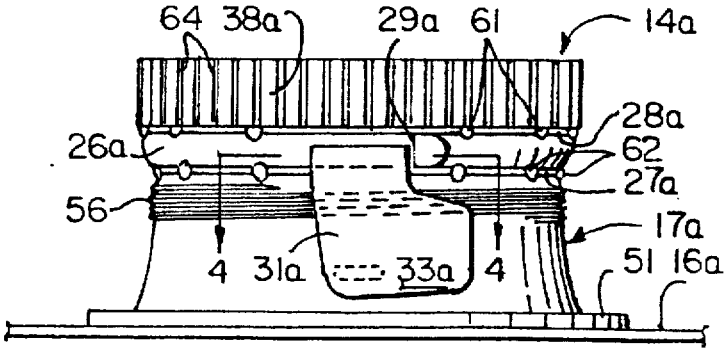
FIG. 7 is a view similar to FIG. 1 of a modification.
Figure 8:
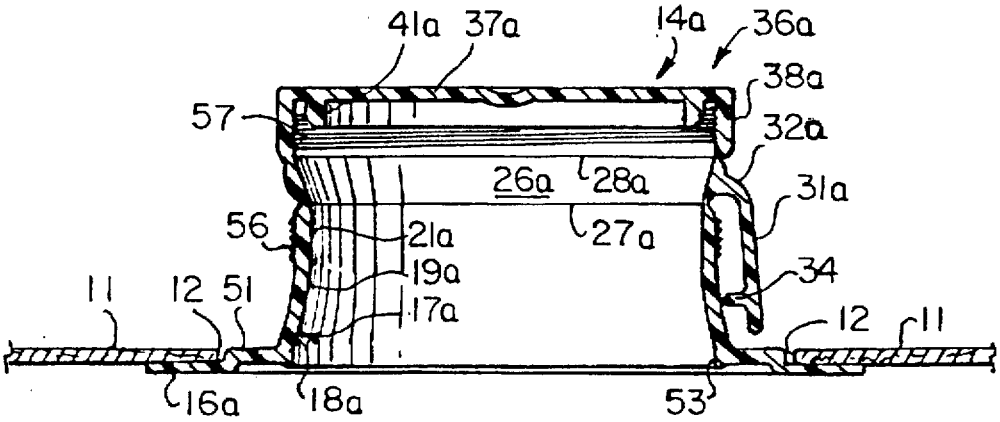
FIG. 8 is a view similar to FIG. 3 of the modification of FIG. 7.
Figure 9:
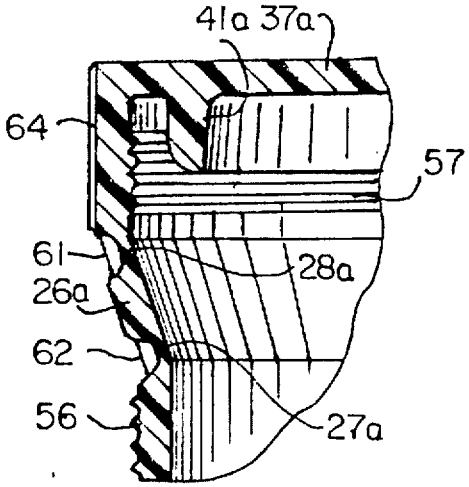
FIG. 9 is an enlarged fragmentary view of a portion of the structure of FIG. 8.

FIGS. 7–9 illustrate a modification of the invention and several additional features which may be incorporated either in the modification of FIGS. 1–6 or the modification of FIGS. 7–9. With respect to the latter it will be seen that flange **16*a* is formed with an upper step 51 having a diameter slightly less than hole 12 and having a height approximately equal to the thickness of panel 11. This structure facilitates centering the fitment 14*a* (or the fitment 14) in the hole 12** during application.

As best shown in FIG. 8, the interior of spout **17*a* may be formed with an inward protruding bead 53 here shown as continuous, but may be interrupted. Bead 53 functions when the fitment 14*a* is attached to a spud on an anvil which transports the fitment from the terminal of a chute leading down from a hopper to a position inside the open upper end of a carton and subsequently moves the fitment so that the spout projects out through the hole 12. The frictional engagement of bead 53** with a spud on the anvil eliminates the necessity of using vacuum and otherwise facilitates application of the fitment.

Still another feature of the invention is the provision of a connector 34 shown in FIG. 8 between the inside of tab **31*a* and the exterior of the spout 17*a*. This prevents the tab from being displaced from its initial position and unintentionally tearing of the tear strip 26*a***.

As best shown in FIG. 7, bridges 61 span upper tear lines **28*a* and bridges 62 span lower tear line 27*a*. Bridges 61 and 62 prevent unintentional severing of the tear lines but are not of sufficient width or strength to prevent the user from tearing through them when the tab 31*a* is gripped and the band 26*a*** is torn off.

The modifications discussed in the preceding four paragraphs may be used with the modification of FIGS. 1–6 as well as with the modification of FIGS. 7–9. One distinguishing feature of the modification of FIGS. 7–9 is the formation of screw threads 56 on the exterior of the upper portion of spout **17*a* and the formation of internal threads 57 on the interior of skirt 38*a*. Although not illustrated in the drawings, it will readily understood that once the band 26*a* has been removed and the user wishes to reclose the container, the cap threads 57** may be used to screw the cap onto the spout.

In a screw cap, use of flange 44 may be eliminated. To facilitate turning the cap **14*a*, vertical external ribs 64 may be formed on skirt 38*a***.

In other respects the modification of FIGS. 7–9 resembles that of FIGS. 1–6 and the same reference numerals followed by subscript a, are used to designate corresponding parts.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A unitary, recloseable fitment comprising a spout having attachment means for securing said spout to a container, said spout having an exterior and an upper end having a external first diameter, first engaging means on said exterior of said spout, a tear band connected to an upper edge of said spout by a lower tear line, said tear band slanting upwardly-outwardly, a cap connected to an upper edge of said tear band by an upper tear line, said tear band being separable along said lower tear line from said spout and along said upper tear line from said cap, said cap having a top, a skirt depending from said top, said skirt having an interior second diameter, second engaging means on said interior of said skirt, said second diameter being slightly larger than said first diameter, said first and second engaging means cooperating to detachably hold said cap on said spout after said tear band has been separated from said spout and from said cap.

2. A fitment according to claim 1 which further comprises tear means on said tear band for removing said tear band.

3. A fitment according to claim 1 in which said spout has an internal third diameter at said upper end and said cap has a cylindrical surface below said top having an external fourth diameter dimensioned to seal against the interior of said third diameter.

4. A fitment according to claim 3 in which said first and second engaging means comprise an additional seal for said cap and said spout.

5. A fitment according to claim 3 in which said cylindrical surface comprises a hollow plug concentric with said skirt.

6. A fitment according to claim 1 in which said top has a peripheral flange extending outward of said skirt for pulling said cap upward relative to said spout.

7. A fitment according to claim 1 in which said first engaging means comprises an external bead having a shoulder and said second engaging means comprises an internal bead positioned to snap under said shoulder when said cap is seated on said spout.

8. A fitment according to claim 7 in which said internal bead is interrupted.

9. A fitment according to claim 1 in which said first engaging means comprise external threads and said second engaging means comprises internal threads mating with said external threads.

10. A fitment according to claim 1 in which said upper and lower tear fines are formed by grooves.

11. A fitment according to claim 10 in which said grooves are external.

12. A fitment according to claim 10 which further comprises circumferentially spaced bridges across said grooves to prevent unintentional rupture of said tear fines.

13. A fitment according to claim 2 in which said tear band is formed with an area of weakness extending between said upper and lower tear lines and in which said tear means comprises a tear tab fixed to said tear band adjacent said area of weakness.

14. A fitment according to claim 13 which further comprises a frangible connector between said tear band and said spout to retain said tear band in position.

15. A fitment according to claim 2 in which said tear means comprises a substantially vertical tear tab positioned outward of said spout and connecting means connecting said tear tab to said tear band, said tear tab depending from said connecting means.

16. A fitment according to claim 1 in which said attachment means comprises a peripheral flange vicinal a lower end of said spout for attaching said fitment to a container.

17. A fitment according to claim 16 in which said flange is formed with a step having a diameter less than a hole in the container through which said spout projects.

18. A fitment according to claim 16 in which said spout slants upward-inward from said flange and then substantially cylindrically to said spout upper end.

19. A fitment according to claim 18 in which said flange is formed with a step having a diameter less than a hole in the container through which said spout projects.

* * * * *